US005417410A

United States Patent [19]

Meier

[11] Patent Number: 5,417,410

[45] Date of Patent: May 23, 1995

[54] METHOD OF COLLECTING AND SUBSEQUENTLY STITCHING FOLDED SHEET-LIKE PRINTED PRODUCTS AND ARRANGEMENT FOR CARRYING OUT THE METHOD

[75] Inventor: Jörg Meier, Oftringen, Switzerland

[73] Assignee: Grapha-Holding AG, Hergiswil, Switzerland

[21] Appl. No.: 48,459

[22] Filed: Apr. 14, 1993

[30] Foreign Application Priority Data

Apr. 14, 1992 [CH] Switzerland ..... 01239/92

[51] Int. Cl.[6] ..... B31B 1/68

[52] U.S. Cl. ..... 270/53

[58] Field of Search ..... 270/53, 54, 55; 271/175, 198, 275

[56] References Cited

U.S. PATENT DOCUMENTS

| | | | |
|---|---|---|---|
| 538,021 | 4/1895 | Jonas | 198/644 X |
| 2,364,504 | 12/1944 | Zuckerman | 270/53 X |
| 2,541,367 | 2/1951 | Kitcat | 270/53 X |
| 3,423,900 | 1/1969 | Orsinger | 270/54 X |
| 3,819,173 | 6/1974 | Anderson et al. | 270/54 |
| 4,489,930 | 12/1984 | Meier | 270/55 |
| 4,614,290 | 9/1986 | Boss | 270/53 X |
| 4,641,825 | 2/1987 | Mowry et al. | 270/53 |
| 4,735,406 | 4/1988 | Weber | 270/53 |
| 5,104,108 | 4/1992 | Honegger | 270/55 |
| 5,137,409 | 8/1992 | Honegger | 270/53 X |
| 5,172,897 | 12/1992 | Hansch et al. | 270/53 |

FOREIGN PATENT DOCUMENTS

| | | |
|---|---|---|
| 0095603 | 12/1983 | European Pat. Off. . |
| 358778 | 1/1962 | Switzerland . |
| 549443 | 5/1974 | Switzerland . |
| 667621 | 12/1978 | Switzerland . |
| 667621 | 10/1988 | Switzerland . |
| 2123389 | 2/1984 | United Kingdom . |

*Primary Examiner*—Edward K. Look
*Assistant Examiner*—John Ryznic
*Attorney, Agent, or Firm*—Friedrich Kueffner

[57] ABSTRACT

A method and an arrangement for collecting and subsequently stitching folded sheet-like printed products. The method includes regularly feeding printed products to a conveying track. The arrangement has a plurality of supports for placing the printed products thereon, wherein the supports extend transversely of the conveying direction and are spaced apart in conveying direction. At least one feeder station is provided for the supports. A stitching apparatus is arranged in front of the end of the conveyor track. The conveyor track is driven by a bending means which engages the supports.

18 Claims, 1 Drawing Sheet 18
21
20
30
15

6
15
8
5
21
1
7
30
15
14
4
11
10
12
9
7
16
13
16
7
19
3
13
17

METHOD OF COLLECTING AND SUBSEQUENTLY STITCHING FOLDED SHEET-LIKE PRINTED PRODUCTS AND ARRANGEMENT FOR CARRYING OUT THE METHOD

BACKGROUND OF THE INVENTION

1. Field of the Invention

The present invention relates to a method and an arrangement for collecting and subsequently stitching folded sheet-like printed products. The method includes regularly feeding printed products to a conveying track. The arrangement has a plurality of supports for placing the printed products thereon, wherein the supports extend transversely of the conveying direction and are spaced apart in conveying direction, and wherein at least one feeder station is provided for the supports. A stitching apparatus is arranged in front of the end of the conveyor track.

2. Description of the Related Art

The above-described method can be carried out by means of a saddle stitcher disclosed in CH-A-667 62 1. This saddle stitcher is constructed with feeder stations which are driven in the machine cycle. The feeder stations are positioned along a plurality of collecting tracks which are arranged parallel to each other. The printed products are placed on top of each other on the collecting tracks and are subsequently pushed in a stepwise fashion by drive members on the collecting tracks against a stitching apparatus. In a special embodiment of this known saddle stitcher, the collecting tracks which are successively fed with printed products from the feeder stations are mounted so as to be axially symmetrically rotatable about an axis. The stitching apparatus following the feeder stations is located at the operating end of the collecting tracks and has at least one pair of stitching heads assigned to at least one collecting track.

An arrangement for collecting and stitching folded printed sheets disclosed in EP-A-03 99 317 also uses the above-described known principle.

While this principle makes it possible to provide an arrangement of compact construction, the functional clarity and control, as well as the accessibility, are impaired. In addition, a change in the production sequence requires a large amount of work.

SUMMARY OF THE INVENTION

Therefore, it is the primary object of the present invention to provide a method and an apparatus of the above-described type in which the above-discussed disadvantages are essentially eliminated. Specifically, the arrangement should be simpler with respect to its manufacture and with respect to use and maintenance thereof.

In accordance with the present invention, the above-described method includes feeding the collected printed products by means of a drivable bending device to the stitching procedure.

The arrangement according to the present invention includes an endless traction means on which the supports are fastened. At least one guide wheel constructed as a stitching wheel has at least one bending means which can be actuated and is arranged distributed over the circumference. The supports and the guide wheel are connected so as to be driven together and form at least one stitching station.

The arrangement according to the present invention makes it possible to work on or change the arrangement within a relatively short time.

In accordance with an advantageous feature of the present invention, at least indirectly following the end of the feeding area for the printed products in conveying direction, the traction means extends approximately spirally or tangentially toward the circumference of the stitching wheel, so that the bending means and supports are aligned in stitching direction.

As a result of this configuration, an efficient saddle stitching can be carried out, wherein the outputs achieved with the conventional arrangements can be reached or even exceeded several times.

Since the traction means extends approximately spirally or tangentially relative to the circumference of the stitching wheel at least indirectly subsequent the feeding end as seen in conveying direction, such that the bending means and the supports are aligned in stitching direction, the feeders of the arrangement of the present invention can be removed or reduced in a simple manner.

Suitable feeders are the known devices which are to be arranged over a portion of the traction means along a predetermined feeding area which extends in front of the bending device as seen opposite the conveying direction. The diameter of the stitching wheel and the travel configuration of the traction means on the stitching wheel can be adapted to existing conditions with respect to processing and space. Of course, the bending means are to be uniformly distributed over the circumference of the stitching wheel, and the supports are to be uniformly distributed over the traction means.

The arrangement according to the present invention makes it possible to precisely conduct the bending means and the supports above each other, so that a stable stitching position is achieved.

The traction means and the stitching wheel form an increasingly narrow wing inlet section, in which the printed products are fed with the leading part into the intermediate space between two bending means, while the trailing part of the printed product is conducted into the intermediate space opposite the respective bending means.

The direction in which the inlet portion extends is determined by the configuration of the portion of the traction means which follows the feeding area in conveying direction and by the relative position of that respective circumferential portion of the stitching wheel, wherein the size of the angle of the inlet portion can also be selected in accordance with the width of the printed products.

In this connection, it is advantageous if the supports have at least one front support side which is inclined downwardly and forwardly, as seen in conveying direction. This front support side increases the stability of the placement of the appropriate components of the printed product.

Feeding of the printed products to the stitching wheel can be improved by constructing the supports so as to be pivotable about an axis extending transversely of the conveying direction between the conveying chains of the traction means, so that the supports can be rotated in the inlet section.

For this purpose, it is advantageous to provide a control cam which positively causes the support to be pivoted.

The intersection can be further improved by providing means for moving the bending means in the area of the inlet section at the circumference of the stitching wheel, wherein the bending means are moved rearwardly, for example, in radial direction.

It is particularly advantageous if, following the inlet section and opposite or adjacent the stitching wheel, a stitching apparatus is arranged which is composed of a plurality of stitching heads facing the stitching stations, so that the stitching procedure can be carried out immediately following the collecting procedure.

To make it possible that the stitching procedure can be carried out while the printed products are being conveyed, so that no time is lost by the stitching procedure, it is advantageous if the stitching apparatus between the inlet section and a subsequent outlet section of the stitched printed products is in drive connection with the stitching wheel.

The stitching heads of the stitching apparatus can be controlled so as to stitch alternatingly or simultaneously. For this purpose, for example, a positively acting mechanical drive device may be provided, or a mechanical-hydraulic/pneumatic drive device or an electrically controlled drive device.

The stitching apparatus may be composed of two parts which each have a stitching head, a pair of stitching heads, or a plurality of stitching heads, which can be driven so as to rotate with the stitching wheel and so as to rotate oppositely the stitching wheel.

In other words, the arrangement of the present invention makes it possible to drive several stitching heads together as a single-piece stitching apparatus during the stitching procedure in the same direction as the stitching wheel and back in the opposite direction on a parallel circular arc. Or, as disclosed by CH-A-667 62 1, the printed products can be stitched by means of several conventional rotary stitching heads on the parallel circular arcs. The stitching heads may carry out the stitching either simultaneously or consecutively.

As an alternative and for avoiding high mass forces, it is possible, as mentioned above, to divide the stitching apparatus into two parts, each having a stitching head or a pair or stitching heads, wherein the parts carry out oppositely directed movements during the stitching procedure, i.e., while one part carries out a movement in the same direction as the stitching movement, the other part is moved backwardly in the opposite direction for receiving a wire section.

It is advantageous if the stitching area of the arrangement is followed by a removal or discharge area for the stitched printed products.

Following the discharge area, the traction means extends in conveying direction away from the circumference of the stitching wheel, either spirally or tangentially, and forms in this manner an outlet section in which the supports move out of the space defined between the bending means.

In accordance with an advantageous further development of the invention, in a bending device formed by two stitching wheels arranged side-by-side next to each other and which are arranged between conveying chains of the circulating traction means, the lateral distance between the stitching wheels is constructed so as to be adjustable and fixable.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there is illustrated and described a preferred embodiment of the invention.

DESCRIPTION OF THE PREFERRED EMBODIMENT

Figures 1, 2:
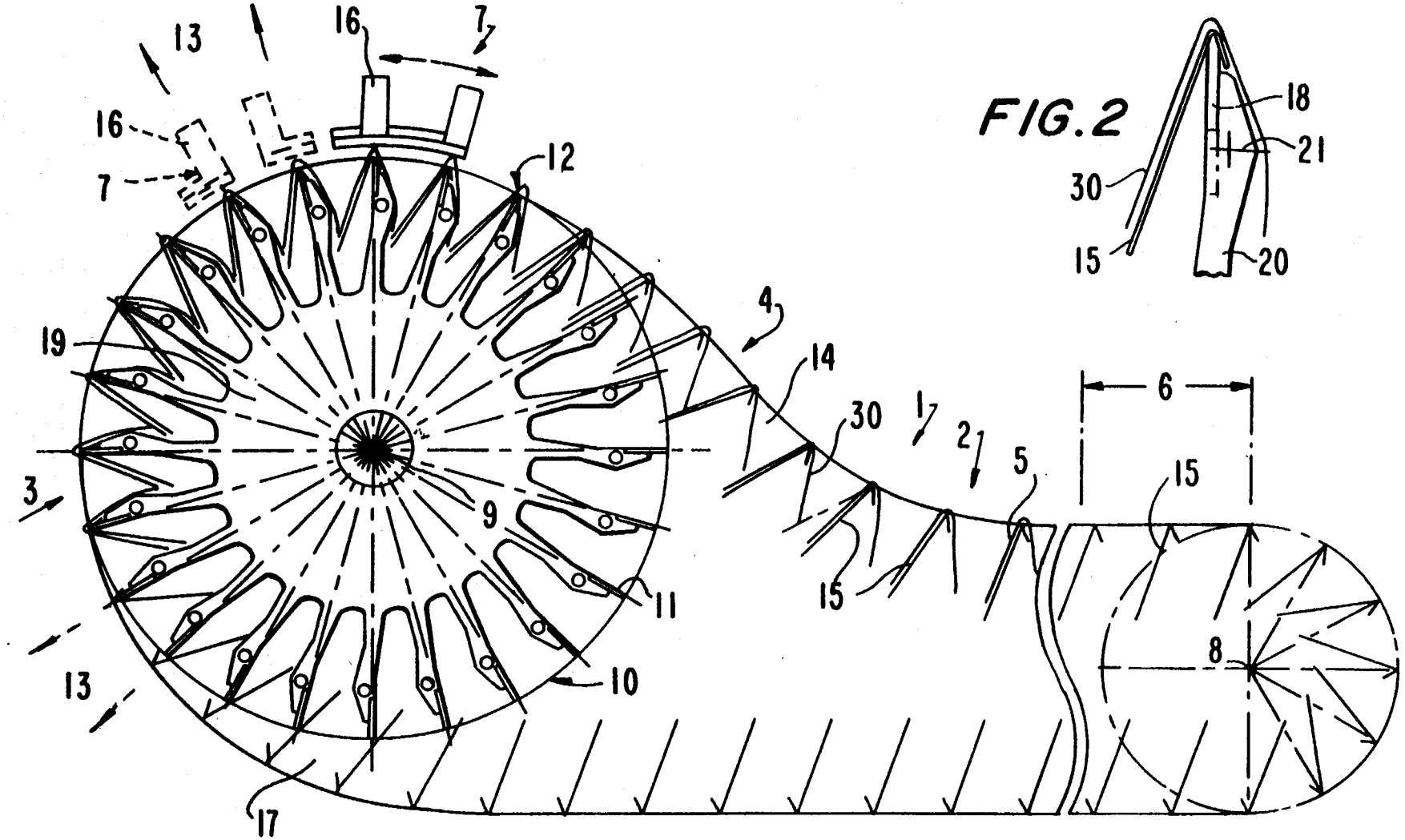
FIG. 1 is a schematic side view of an arrangement for carrying out the method of the present invention.
FIG. 2 is a schematic view, on a larger scale, of a stitching station of the arrangement of FIG. 1.

FIG. 1 of the drawing shows an arrangement 1 for collecting and subsequently stitching folded sheet-like printed products 30. The printed products are transferred in regular intervals to a driven conveying track 2 and are supplied to the stitching procedure by means of a drivable bending device 3. The conveying track 2 is formed by several saddle-type supports 5 which are mounted spaced apart from each other and transversely of the conveying direction on a traction means 4. The folded printed products are placed in saddle-type fashion on the supports 5. In the feeding area 6, feeders, not shown, are assigned to the supports 5. The feeders supply differently printed products of the same size.

A stitching apparatus 7 is arranged directly or indirectly following the feeding area 6 in front of the end of the conveying track 2. The endless traction means 4 passes the stitching apparatus 7. The endless traction means 4 is constructed so as to travel around two parallel axes 8, 9, wherein the axis 9 is provided for supporting the guide wheel constructed as a stitching wheel 10. The stitching wheel 10 has drivable or actuatable bending devices 11 distributed over the circumference of the stitching wheel 10 with the same spacing as the supports 5. The bending devices 11 form stitching stations with the stitching wheel 10 in the range of movement of the stitching apparatus 7.

The bending apparatus 3 could also be composed of two chain wheels forming the traction means 4, wherein the chain wheels are connected to each other by means of transversely extending members which are mounted distributed over the circumference of the chain wheels and spaced in accordance with the supports 5 and are provided with bending devices.

The bending apparatus 3 could also be composed of two stitching wheels 10 which are rigidly connected to each other and form a stitching drum, so that the apparatus could also be considered a single stitching wheel.

On the other hand, the bending apparatus could also be composed of three stitching wheels 10 with the above-described features.

Following the end of the feeding area 6 in conveying direction, the traction means 4 extends along an ascending portion approximately spirally against the circumference of a guide wheel constructed as a stitching wheel 10. In the illustrated embodiment, the arrangement 1 is composed of two conveyor chains, not shown, which form the traction means for and are mounted laterally next to each other and carry the supports 5, as well as two guide or stitching wheels 10, i.e., bending arrangements, on the axis 9 and two additional guide wheel at the axis 8. The upper portion of the traction means 4 could also be arranged so that it approaches the stitching wheels 10 at a smaller angle of inclination, tangentially or downwardly inclined from the top in a spiral configuration.

The illustrated embodiment represents a space-saving configuration of the arrangement 1 which makes it possible to provide feeder stations of minimum structural height in the feeding area 6 above the traction means 4. The bending devices 11 at the stitching wheels 10 and the supports 5 are aligned in stitching direction at the bending arrangement 3 and form stitching stations 12.

An inlet section 14 is formed in front of the stitching stations 12 by the ascending portion of the traction means 4 and the stitching wheels 10, wherein the width of the distance between the traction means 4 and the stitching wheels 10 decreases in conveying direction. In the inlet section 14, the front support sides 15 of the supports 5 which extend forwardly and downwardly enter between the bending devices 11 fastened to the stitching wheels 10 and are aligned above the bending devices 11. Thus, if the angle of the upper portion of the traction means 4 relative to the horizontal toward the stitching wheels 10 is flat, the inlet section 14 is narrow.

If the inlet section 14 is narrow, it is advantageous to construct the supports 5 so as to be pivotable and controllable by appropriate means, not shown. For the same purpose, the bending devices 11 could be constructed so as to be retractable in a controlled manner in the area of the inlet section 14, so that more space is available for the movement of the support sides 15.

A stitching apparatus 7 is arranged following the inlet section 14 and preferably above the bending apparatus 3 for the stitching wheels 10. The stitching apparatus 7 includes two stitching heads 16 or pairs of stitching heads which face the stitching stations 12 formed of stitching wheels 10 and supports 5.

The stitching apparatus 7 is mounted so as to be in drive connection with a section on the circumference of the stitching wheels 10 or a section of the stitching stations 12 with the bending apparatus 3 determined for stitching or the stitching wheels 10 so as to travel together therewith and opposite to the work cycle. In other words, the stitching stations 12 provided for stitching travel together with the printed products through a stitching section within which the stitching of the printed product is carried out, at the same angular velocity or circumferential speed as the stitching heads 16 of the stitching apparatus 7. After stitching has been carried out, the stitching apparatus 7 is raised from the supports 5 and is swung back against the conveying direction into the initial position. The wire section required for stitching can be picked up or cut by a stitching head and transported already during the return stroke of the stitching apparatus 7. Before the stitching apparatus 7 reaches the same angular velocity as the stitching wheels, the stitching apparatus 7 is accelerated from the initial position, and the stitching heads are lowered onto the supports 5 immediately when the stitching section is reached. During this procedure, the wire section is pre-shaped into a shape which can be driven into the printed products. Subsequently, the wire sections are driven with side portions thereof through the collected printed products and are bent at the oppositely moved bending devices 11. The stitching heads 16 are then lifted off and begin their return movement into the initial position.

As indicated by the stitching apparatus shown in solid lines in FIG. 1, it is possible that the stitching procedure can be carried out simultaneously by all stitching heads 16 above all supports 5 or the stitching procedures of the individual stitching heads can be carried out successively to each other.

As indicated by a stitching apparatus shown in broken lines in FIG. 1, to avoid high mass forces due to the alternating drive of the stitching apparatus 7 or the stitching head 16, the stitching apparatus 7 can be divided into two parts which alternatingly travel forwardly and backwardly opposite each other. For this purpose, the stitching heads 16 are each connected to one of two rocker members which are driven in opposite direction but carry out at least approximately the same movements as the stitching heads 16 of the stitching apparatus 7 which are driven together and form a unit.

The wire sections can be fed to the stitching heads 16 either by a device which cuts the wire section to length or by the stitching head itself. Both possibilities are known in the art, wherein a wire supply device or a wire advancing device is provided for each stitching head.

The removal of the stitched printed products as indicated by arrows in FIG. 1 is effected directly or indirectly following the stitching section, for example, by means of clamps which grasp the printed products or by ejectors. The removal can also be effected by the weight of the printed products or by gravitation or centrifugal force in the area underneath the axis 7 of the stitching wheels 10.

The outlet section 17 is constructed similar to the inlet section 14. In other words, the lower portion or portions of the traction means 4 leave the chain wheels which are in driven connection with the bending apparatus 3, either spirally or tangentially, so that the support sides 15 of the supports 5 can travel without problems out of the space between the bending devices 11. If necessary, in the outlet section 17, a positively acting control for pivoting the support sides 15 or supports 5 about the longitudinal axes thereof may be provided.

For adapting or optionally selecting the distance between two clamps, the distance between the two stitching wheels 10 forming the bending apparatus 3 may be adjusted or changed.

The bending apparatus 3 is arranged between endless conveyor chains, each of which is mounted on an outer side of the stitching wheels 10.

FIG. 2 of the drawing schematically shows a detail of the stitching station 12. The stitching station 12 includes a bending block 18 with bending members, not shown, and a carrier member 20 of the bending block connected to the hub 19 of the stitching wheel 10. A support 5 is shown above the bending block 18. ;he drive axis of the bending device is denoted by reference numeral 21.

It should be understood that the preferred embodiment and examples described are for illustrative purposes only and are not to be construed as limiting the scope of the present invention which is properly delineated only in the appended claims.

We claim:

1. An arrangement for collecting and subsequently stitching folded sheet-like printed products, the arrangement comprising an endless traction means traveling in a conveying direction, supports mounted on the traction means, the supports extending transversely of the conveying direction and being spaced apart in the conveying direction, the supports being configured to receive the printed products in a saddle-like fashion, feeding means for feeding the printed products to the supports, the traction means having a conveying end, a stitching apparatus mounted adjacent the traction means in front of the conveying end in the conveying direction, a stitching wheel having a circumference, bending means being mounted circumferentially distributed on the stitching wheel, the bending means engaging the supports for driving the traction means and for forming at least one stitching station opposite the stitching apparatus.

2. The arrangement according to claim 1, wherein the traction means has a feeding area for the printed products, the feeding area having an end, wherein the traction means extends following the end of the feeding area in the conveying direction approximately tangentially relative to the circumference of the stitching wheel, so that the bending means and the supports are aligned in a stitching direction.

3. The arrangement according to claim 2, comprising an inlet section defined by the traction means and the stitching wheel, wherein a distance between the traction means and the stitching wheel continuously decreases in the conveying direction toward the stitching wheel from the end of the feeding area.

4. The arrangement according to claim 3, wherein the inlet section extends approximately horizontally.

5. The arrangement according to claim 3, wherein the inlet section extends inclined upwardly toward the stitching wheel from the end of the feeding area.

6. The arrangement according to claim 1, wherein the traction means comprises two parallel conveying chains, the conveying chains being connected in a direction transversely of the conveying direction by the supports, wherein each support has at least one front support side which extends downwardly and forwardly in the conveying direction.

7. The arrangement according to claim 6, wherein each support is connected to the conveying chains so as to be pivotable about an axis extending transversely of the conveying direction.

8. The arrangement according to claim 7, comprising control means for pivoting the supports, the control means being mounted at least in the inlet section.

9. The arrangement according to claim 3, wherein the bending means comprise control means for retracting the bending means from the circumference of the stitching wheel, the control means being mounted in the inlet section.

10. The arrangement according to claim 3, wherein the stitching apparatus comprises a plurality of stitching heads, the stitching apparatus being mounted opposite the circumference of the stitching wheel and following the inlet section in the conveying direction.

11. The arrangement according to claim 10, wherein the traction means comprises an outlet section, the arrangement further comprising a drive means connecting the stitching apparatus with the stitching wheel between the inlet section and the outlet section.

12. The arrangement according to claim 10, comprising means for alternatingly actuating the stitching heads.

13. The arrangement according to claim 10, comprising means for simultaneously actuating the stitching heads.

14. The arrangement according to claim 1, wherein the stitching apparatus comprises two components, each having at least one stitching head, the components being in driven connection with the bending means, such that the components travel together in the conveying direction and opposite the conveying direction.

15. The arrangement according to claim 1, wherein the stitching apparatus comprises two components, each having at least one stitching head, the components being in driven connection with the bending means, such that the components travel alternatingly in the conveying direction and opposite the conveying direction.

16. The arrangement according to claim 11, wherein the traction means comprises a removal area for the stitched printed products, the removal area being located between the stitching apparatus and the outlet section in the conveying direction.

17. The arrangement according to claim 16, wherein the traction means extends tangentially relative to the stitching wheel following the removal area in the conveying direction.

18. The arrangement according to claim 1, wherein the stitching wheel comprises two stitching wheel portions arranged laterally next to each other, the traction means being conveying chains engaging the stitching wheel, further comprising adjusting means for adjusting the lateral spacing between the stitching wheel portions.

* * * * *